US006330963B1

(12) United States Patent
Olden et al.

(10) Patent No.: US 6,330,963 B1
(45) **Date of Patent: *Dec. 18, 2001**

(54) APPARATUS FOR CONNECTING WOODEN COMPONENTS

(75) Inventors: Marc Olden, Pacific; Kathy Liuhui Jin, Chesterfield, both of MO (US)

(73) Assignee: MiTek Holdings, Inc., Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/419,582

(22) Filed: Oct. 18, 1999

(51) Int. Cl.[7] ..... B27F 7/02
(52) U.S. Cl. ..... 227/152; 227/154; 227/99
(58) Field of Search ..... 227/154, 155, 227/152, 151, 4, 99, 100, 136; 100/913, 918, 224, 229 R; 269/910, 290

(56) References Cited

U.S. PATENT DOCUMENTS

| | | | | |
|---|---|---|---|---|
| 3,100,301 | * | 8/1963 | Black | 227/154 |
| 3,591,067 | * | 7/1971 | Vial | 227/155 |
| 3,713,381 | * | 1/1973 | Mort et al. | 227/152 |
| 3,848,495 | * | 11/1974 | Youra | 100/918 |
| 3,895,708 | | 7/1975 | Jureit et al. | 206/53 |
| 3,913,816 | | 10/1975 | Jureit et al. . | |
| 3,939,542 | * | 2/1976 | Reggi | 227/136 |
| 3,939,548 | | 2/1976 | Jureit et al. | 29/432 |
| 3,964,663 | | 6/1976 | Jureit et al. | 227/95 |
| 4,025,028 | * | 5/1977 | Jureit et al. | 227/95 |
| 4,081,893 | | 4/1978 | Jureit et al. . | |
| 4,275,854 | | 6/1981 | Jureit et al. . | |
| 4,426,059 | * | 1/1984 | Mort | 227/152 |
| 4,429,629 | * | 2/1984 | Leonard | 100/913 |
| 4,567,821 | * | 2/1986 | McDonald | 227/152 |
| 4,627,564 | * | 12/1986 | Bowser | 227/154 |
| 4,650,104 | * | 3/1987 | Seki | 227/154 |
| 4,691,554 | * | 9/1987 | Murphy | 100/224 |
| 5,085,414 | | 2/1992 | Weaver . | |
| 5,092,028 | | 3/1992 | Harnden . | |
| 5,873,567 | | 2/1999 | Williams . | |

OTHER PUBLICATIONS

U.K. Search Report Under Section 17, Application No. GB 0025567.9, Apr. 24, 2001.

* cited by examiner

*Primary Examiner*—Scott A. Smith
(74) *Attorney, Agent, or Firm*—Senniger, Powers, Leavitt & Roedel

(57) ABSTRACT

Apparatus for connecting wood members with a connector plate segmented from a continuous strip of connector plates. The connector plates have integral nails extending from one face of the plate. The apparatus includes a feeder for feeding the strip forward to a position where the connector plate is segmented from the strip. A driver drives the segmented plate into the wood members. The apparatus has a table for the emplacement of the wood members in a pattern for being fastened together. The table is mounted for movement between a position out from under the driver for emplacement of the wood members and a position under the driver for the driving of a segmented connected plate down for penetration of its nails into the wood members. The table also has slots and locating stops to facilitate holding the wood member is the pre-selected pattern on the table.

15 Claims, 6 Drawing Sheets

APPARATUS FOR CONNECTING WOODEN COMPONENTS

This invention relates to apparatus for connecting wooden components and the like, and more particularly to apparatus for emplacement of wooden components in position for being joined together (jigging said members) and having means for fastening said members together by driving connector plates (nailing plates) thereunto.

BACKGROUND OF THE INVENTION

The invention is in the field of automated wooden component connection apparatus of the type in which components are placed in position on a table (jigged) in the position in which they are to be fastened together, and connector plates (nailing plates) segmented from continuous connector plate strip are driven into said components, one from above, one from below through an opening in the table, for the fastening together of said components. This type of apparatus is well known in the art; reference may be made to the copending coassigned Ser. No. 09/347,326, filed Jul. 2, 1999, entitled Coil Advance Drive for an Apparatus for Applying Links of Connector Plate Coils to Wooden Frames, showing such apparatus, said application being incorporated herein by reference. An example of such a machine is Model No. 35500 Coilfed Machine available from MiTek Industries, Inc. of St. Louis, Mo. Another example of such a machine is shown in U.S. Pat. No. 3,913,816. These machines are characterized by their use of a coil of connector plate material, such as shown in U.S. Pat. No. 3,895,708, rather than preformed individual plates. Said prior apparatus is used, for example, to make hip roof trusses or wood crates, for manufacturing wooden frames for furniture or box springs, and to make other wood assemblies. The prior apparatus has been generally satisfactory but, at times, some difficulty has been encountered in the emplacement of the wood members in jigged position on the table due to the obstruction of the table by connector plate segmenting and driving instrumentalities overhanging the table.

BRIEF SUMMARY OF THE INVENTION

Among the several objects of this invention may be noted the provision of apparatus of the type described above improved to the extent of facilitating the manual emplacement (jigging) of the wooden members to be fastened together by the connector plates; the provision of such apparatus wherein the emplacement may be carried out without obstruction from the connector plate segmenting and driving instrumentalities; the provision of such apparatus enabling set-up of various jigging patterns for the wooden members; and the provision of such apparatus which is of relatively simple and economical construction and relatively simple and convenient to use.

In general, apparatus of this invention is for connection of wooden components or the like in which wood members are fastened together by a connector plate segmented from a continuous strip of connector plates, said plates having integral nails extending from one face thereof and connected end-to-end lengthwise of the strip. It comprises a feeder operable to feed the strip forward with its nails extending down to bring the leading plate of the strip to a position for being segmented from the strip and driven downward, and a driver for driving the segmented strip down. It is characterized in having a table for the emplacement thereon of wood members in a pattern for being fastened together, said table being mounted for movement between a position out from under said driver for emplacement of said members and a position under said driver for the driving of a segmented connector plate down for penetration of its nails into said members.

Other objects and features will be in part apparent and in part pointed out hereinafter.

BRIEF DESCRIPTION OF THE DRAWINGS

Corresponding reference characters indicate corresponding parts throughout several views of the drawings.

DESCRIPTION OF THE PREFERRED EMBODIMENT

Figure 1:
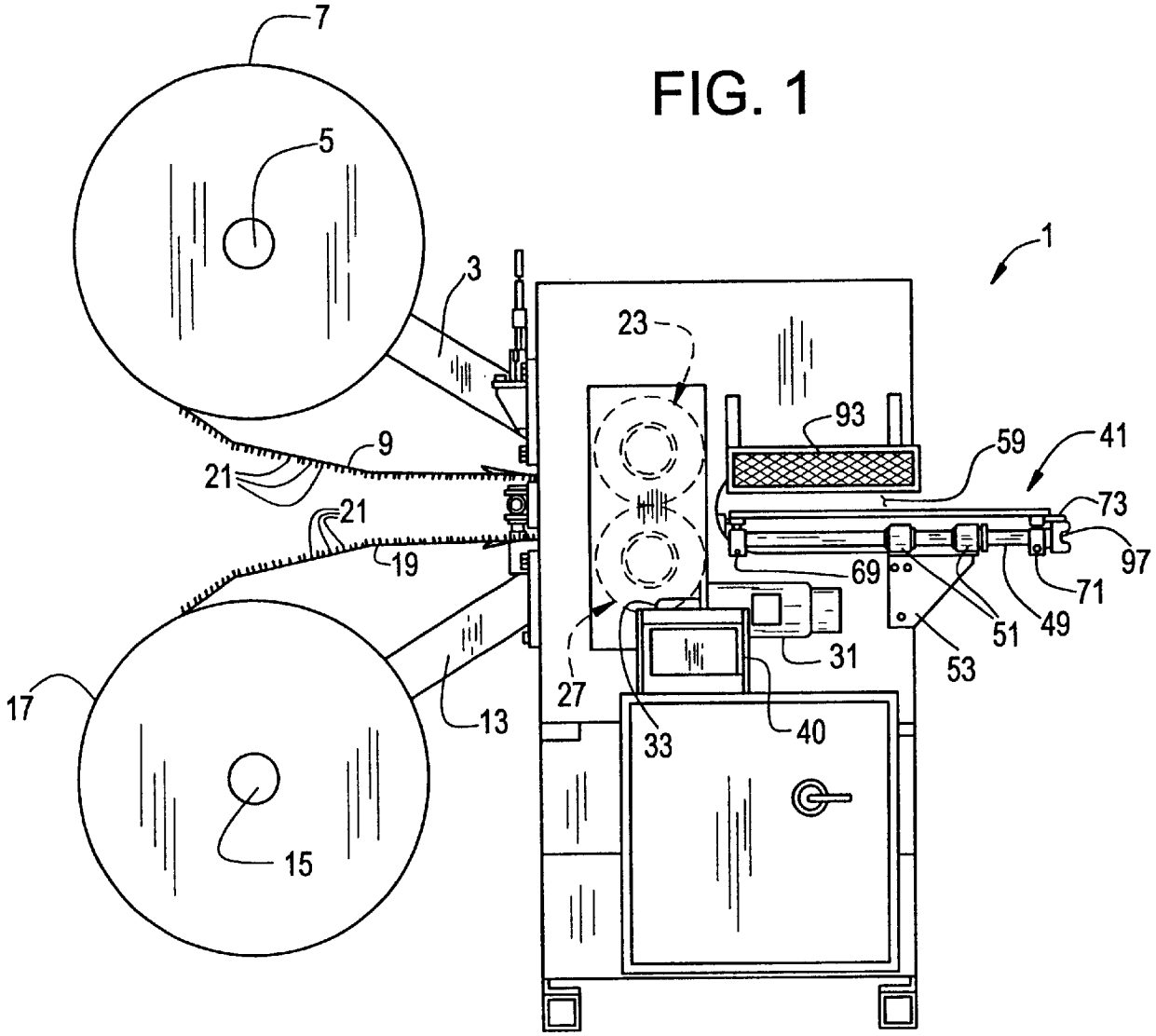
FIG. 1 is a view in elevation of one side of apparatus embodying the invention.
Figure 2:
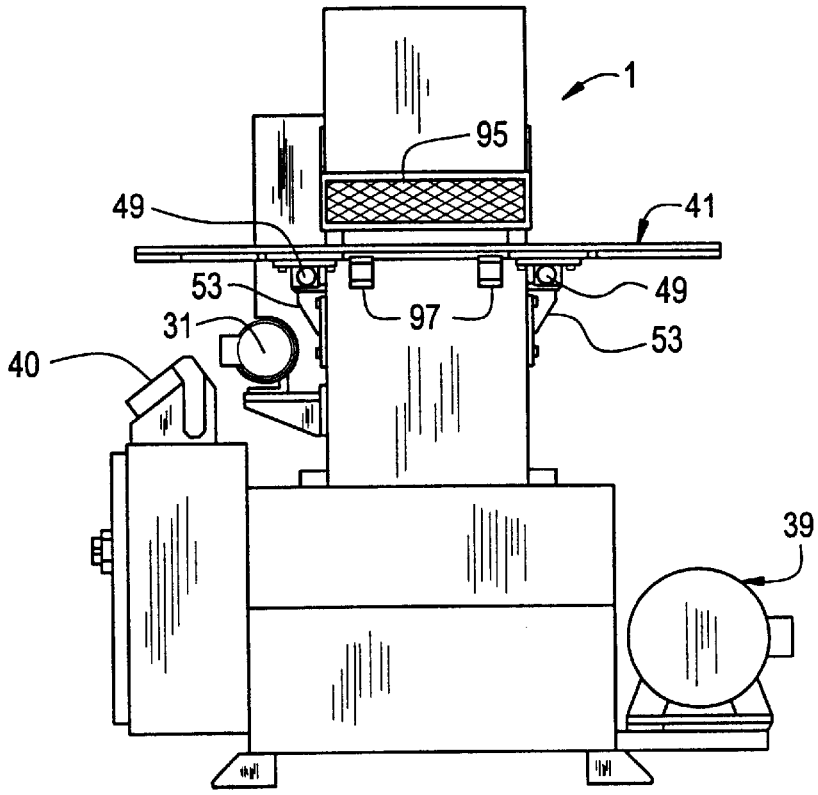
FIG. 2 is a view in front elevation of the apparatus.
Figure 3:
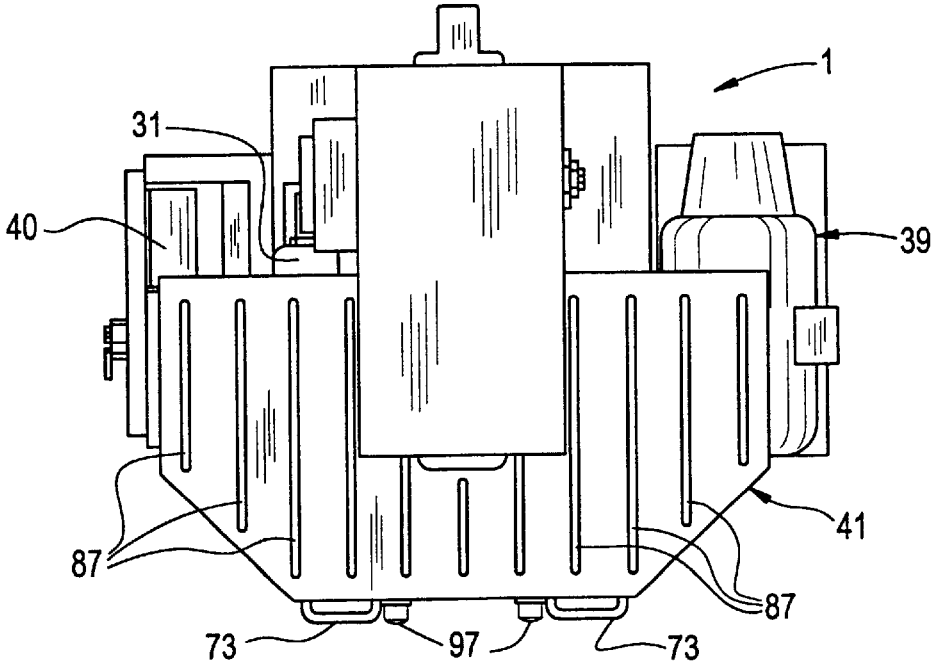
FIG. 3 is a plan of FIG. 2.

Referring to the drawings, first more particularly to FIGS. 1–3, apparatus of this invention is shown to comprise a frame indicated in its entirety by the reference numeral 1 having a front and a back, an upper arm 3 extending outwardly therefrom in what amounts to rearward direction having a spindle 5 at its outer end carrying a supply in the form of a coil 7 of a strip 9 of connector plates (which may also be referred to as nailing plates) and a lower arm 13 extending outwardly therefrom below the upper arm having a spindle 15 at its outer end carrying another supply in the form of a coil 17 of a strip 19 of connector plates (which may be the same as strip 9). Such connector plates and strips thereof are well known in the art and it will be readily understood by those conversant with the art that each connector plate is a metal (usually steel) plate having nails 21 integrally formed therefrom extending from one face thereof, strips of said plates comprising a multiplicity of the plates integrally connected end-to-end lengthwise of the strip, the leading plate of the strip being adapted to be segmented from the strip and driven into pieces of wood for fastening them together.

Figure 5:
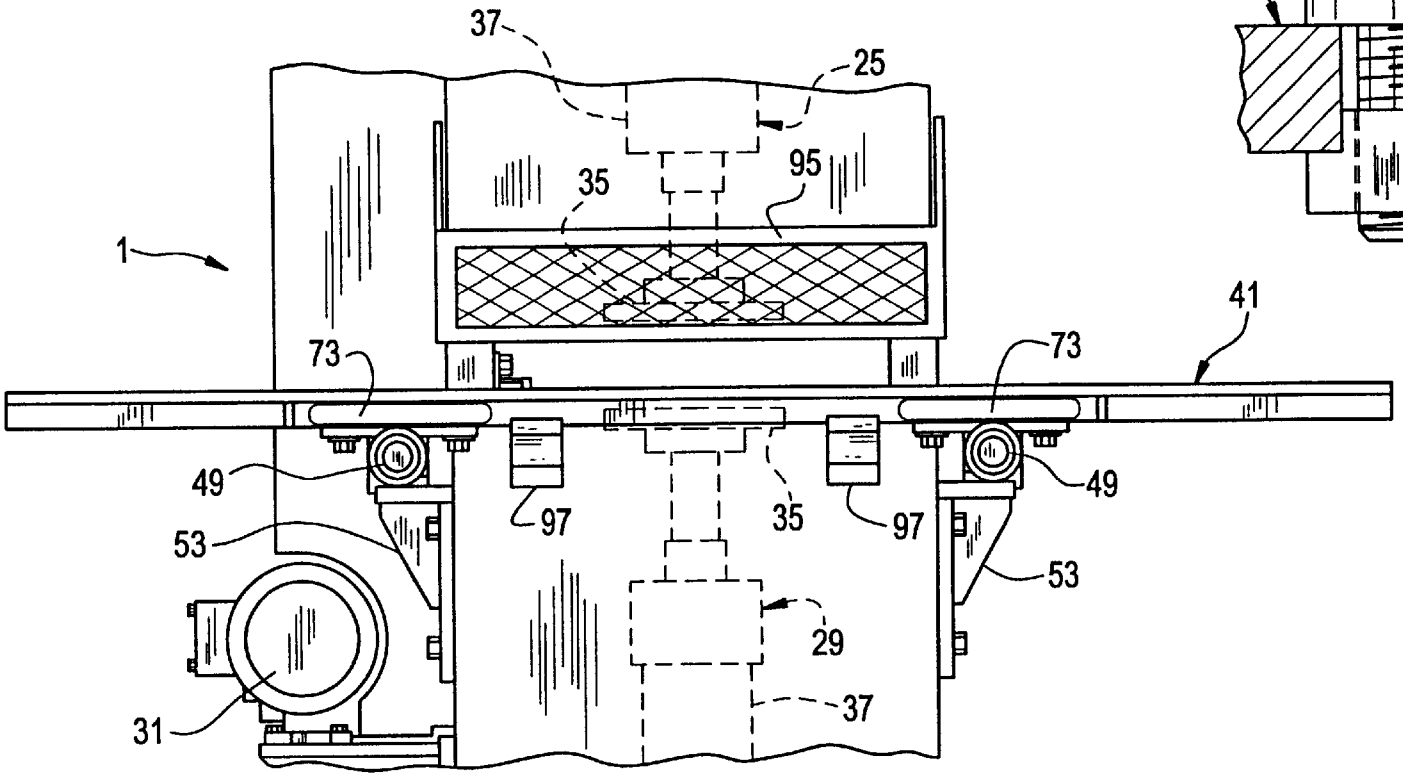
FIG. 5 is a view in elevation of a fragment of the front of the apparatus.

Mounted in the frame 1 is an upper feeder 23 operable to feed forward the upper strip 9 of connector plates from the upper coil 7 with its nails 21 extending down to bring the leading plate of the upper strip to a position for being segmented from the upper strip and driven downward. An upper driver 25 (FIG. 5) mounted in the frame functions to drive down the plate segmented from the upper strip. Mounted in the frame 1 directly below the upper feeder is a lower feeder 27 operable to feed forward the lower strip 19 of connector plates from the lower coil 17 with its nails 21 extending up to bring the leading plate of the lower strip to a position for being segmented from the lower strip and driven upward. A lower driver 29 (FIG. 5) mounted in the frame functions to drive up the plate segmented from the lower strip. Each feeder generally comprises a wheel rotary on a horizontal axis contacting the respective strip, the wheel being adapted to be driven on each cycle of operation of the apparatus to advance the respective strip one connector plate length by a motor 31 via a drive indicated at 33. Each of the connector plate drivers 25, 29 comprises a presser platen 35 on the plunger of a hydraulic cylinder 37, the upper presser platen being movable down for pressing down the connector plate segmented from the upper strip, the lower presser platen being movable up for pressing up the connector plate segmented from the upper strip. At 39 is indicated means for supplying the hydraulic cylinders with hydraulic fluid under pressure and controlling them (FIG. 2). A control panel 40 is provided for setting the operating parameters of the apparatus 1. The apparatus as thus far described corresponds essentially to that disclosed in the aforesaid copending coassigned application Ser. No. 09,347,326, and reference may be made thereto for details.

In accordance with this invention, a table 41 is shown for emplacement thereon of wood members, such as the wood members indicated at 43 and 45 (FIGS. 6 and 7) in a pattern for being fastened together. The table 41 is mounted for movement on the frame 1 between a position for emplacement of the wood members thereon out from between the upper and lower drivers 25 and 29 shown in phantom in FIG. 4 and a position between the drivers shown in solid lines in FIG. 4 for the driving of a connector plate segmented from the upper strip 9 down, and the driving of a connector plate segmented from the lower strip 19 up through an opening 47 in the table, for penetration of the nails 21 of the segmented plates into the wood members 43, 45.

Figure 4:
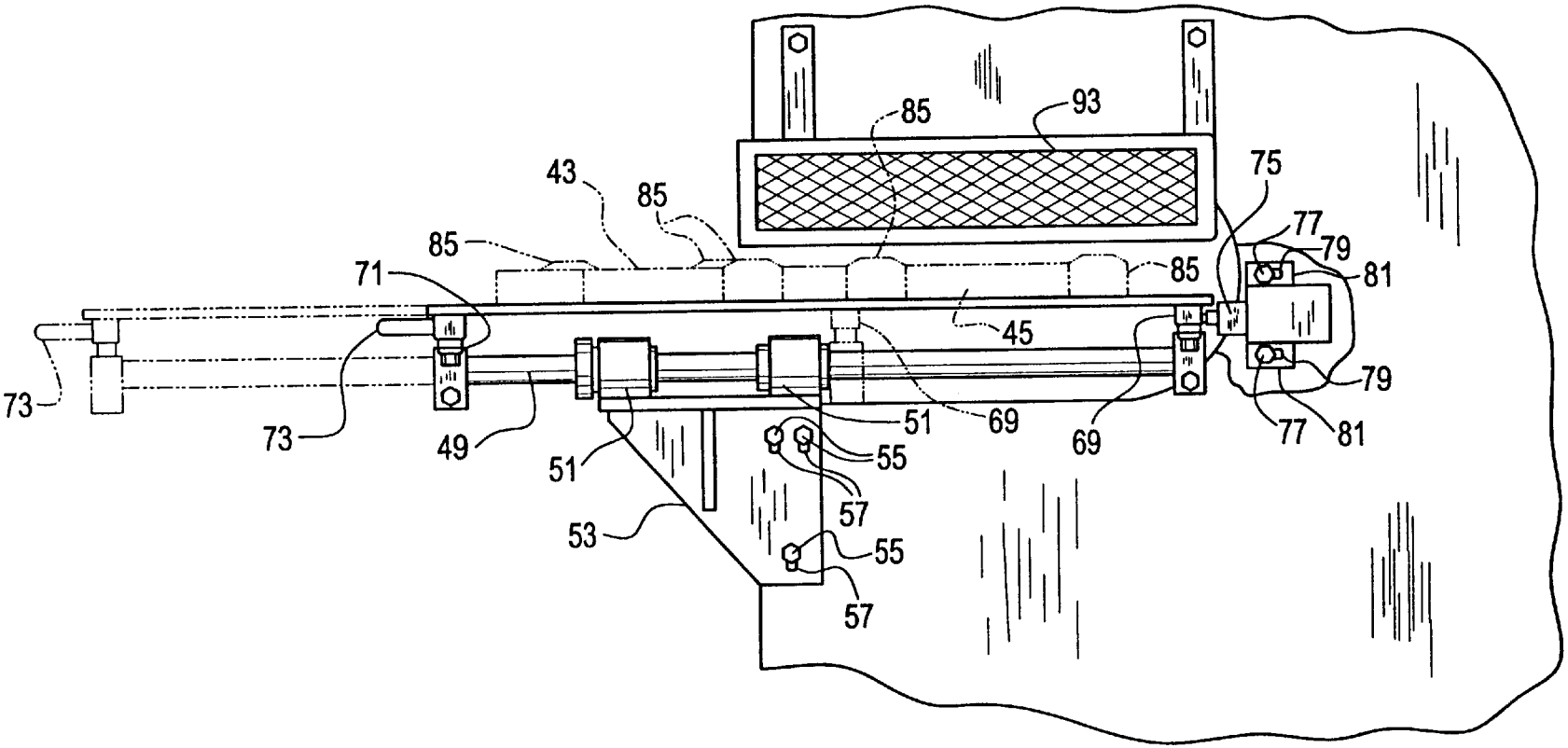
FIG. 4 is a view in elevation of a fragment of the other side of the apparatus, showing in phantom a moved position (the loading position) of a table thereof.

The table 41 is mounted for sliding movement between its above-stated in and out positions (which may also be referred to as its plate-driving position and loading position) in a generally horizontal plane by means of a set of rods, more particularly two rods each designated 49, and a set of slide bearings, more particularly a pair of linear bearings each designated 51 on one side and a pair of linear bearings each designated 51 on the other side under the table. Each pair of bearings is fixed on top of a bracket 53 mounted for up and down adjustment on the respective side of the frame 1 by means of screws 55 extending through generally vertical slots 57 in the bracket and threaded in tapped holes in the frame, the two bearings on each bracket being spaced one from the other on the bracket as shown in FIG. 4. The brackets with the bearings thereon are mounted on the frame with their axes extending parallel to one another on opposite sides of the throat 59 (in a generally horizontal plane open at the front of the frame) between the drivers 25 and 29 in a generally horizontal plane below the plane of the table 41. The rods 49 are secured to the table in position below the table spaced down from the table extending parallel to one another in the plane of the bearings 51 (and generally parallel to the plane of the table), being slidable in the bearings for the aforesaid sliding movement of the table between its aforesaid two positions. The table 41 has an inner edge 61, namely the edge which is innermost with respect to the throat (rearward with respect to the apparatus), and an outer (front) edge 63. Extending crosswise of the table on the bottom thereof adjacent its inner and outer edges are bars 65 and 67, the bar adjacent the inner edge 61 being denoted the inner or rear bar and the bar adjacent the outer edge being denoted the outer or front bar. Each of the rods is secured to the table in position under and spaced from the bottom surface of the table by a pair of rod supports 69 and 71, the support 69 being adjacent the inner end of the rod and the support 71 being adjacent the outer end of the rod. The inner end support 69 comprises a collar encircling the rod depending from bar 65 and the outer end support 71 comprises a collar encircling the rod depending from bar 67.

Each of the two inner bearings 51 of each pair of bearings on the brackets 53 is mounted in position with respect to the frame 1 to act as a stop engageable by the rear collar 69 of the respective inner end rod support on pulling out the table to determine its aforesaid loading position. Handles 73 are provided at the front of the table for being grasped to pull it out to the loading position, in which the inner (rear) edge 61 of the table is near the outer (open) end of the throat 59 (its front end). The handles are attached to bar 67. Mounted in the frame at the inner end of the throat 59 is a limit switch 75 engageable by the rear bar 65 of the table. The upper and lower drivers 25 and 29 cannot be activated when the table 41 is out of contact with the limit switch. This limit switch is adjustable in and out as needed to position the table. For that purpose, the limit switch 75 is mounted on the frame 1 by means of screws 77 extending through generally horizontal slots 79 in wings 81 on the stop threaded in tapped holes in the frame. A stop engageable with the forward bearing 51 to determine the aforesaid position for the driving of connector plates into the wood members of the table 41 is provided by a collar 83 on one or both rods 49 adjustable to different positions thereon for engagement with the front of one or both of the forward bearings 51 as shown in FIG. 4.

Figure 8:
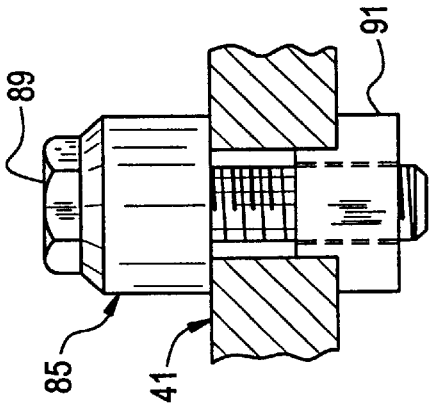
FIG. 8 is a section taken generally on line 8—8 of FIG. 7 illustrating a jigging stop of the apparatus.
Figure 6:
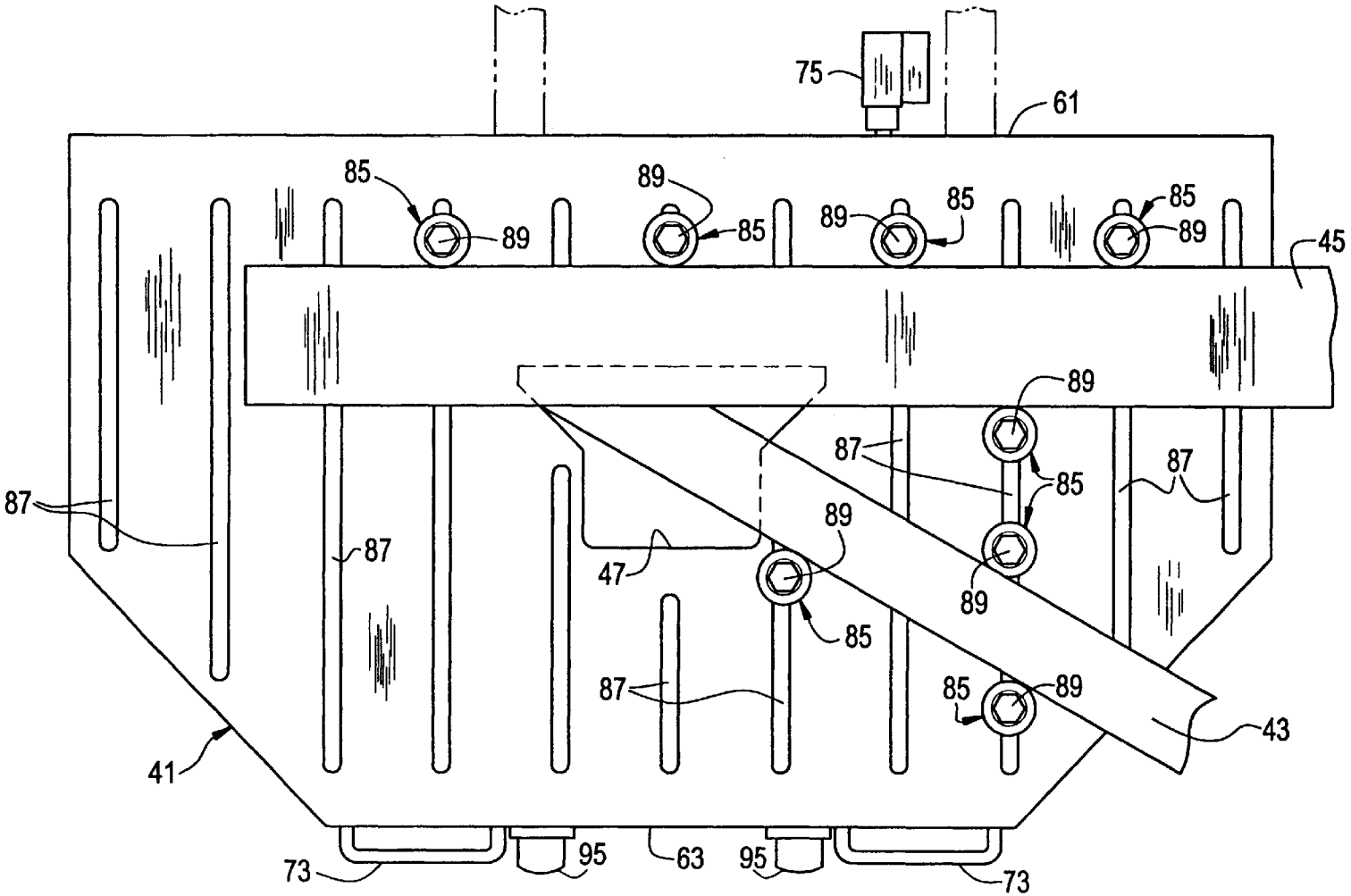
FIGS. 6 and 7 are views of the table taken generally on lines 6—6 and 7—7 of FIG. 5 illustrating a first wood member and a second wood member of a hip girder jigged in position for being fastened together with connector plates by the apparatus.
Figure 7:
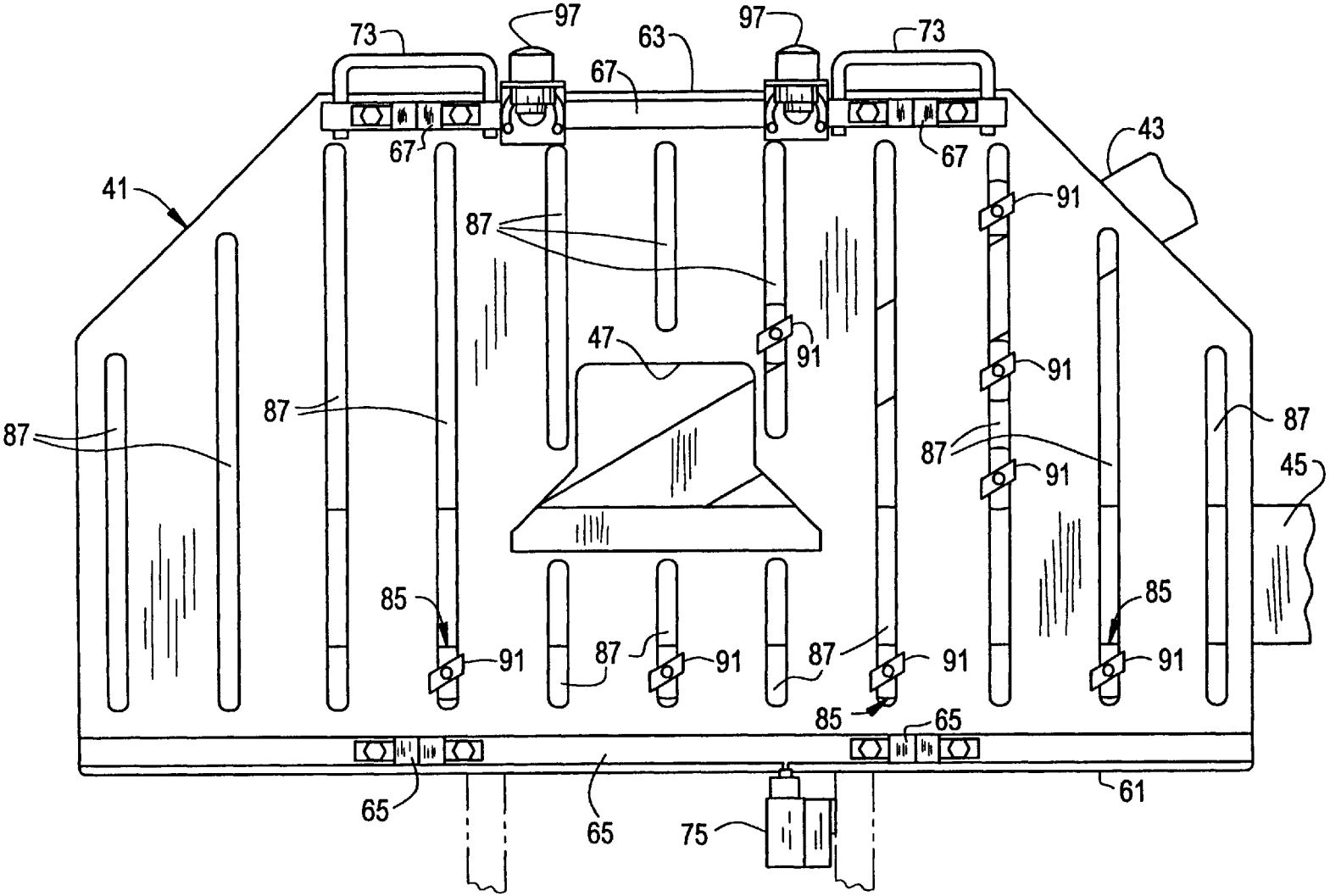

Referring to FIGS. 6–8, the table 41 carries jigging members, more particularly stops each designated 85, for jigging the wood members in the pattern for the connection thereof by the connector plates. As shown, the table is made with a series of slots 87 therein, the slots extending parallel to one another in front-to-rear direction with respect to the throat 59. It is to be understood that the slots may extend in a side-to-side direction with respect to the throat 59 or in some combination of front-to-rear and side-to-side without departing from the scope of the present invention. Further, it is envisioned that instead of slots a large number of circular holes (not shown) could be provided in the table. The holes would be threaded so that stops having threaded pegs could be screwed into the holes. Different jigging arrangements would be made by selecting different holes into which to place the stops. In the illustrated embodiment, each stop 85 is releasably fastened in selected position along the length of a slot extending up from the table for the jigging of wood members on the table in a selected pattern by having a bolt 89 of smaller diameter extending through the stop. The stop 85 has a downwardly facing shoulder engaging the top surface of the table on opposite sides of the slot with the bolt 89 extending down through the slot. A quarter turn nut 91 threaded on the bolt 89 engages the bottom surface of the table for fastening the stop 85 in place.

FIGS. 6 and 7 show an arrangement of the stops 85 for positioning (jigging) the first wood member 43 and the second wood member 45 of a hip girder of a type wherein the first wood member extends at an acute angle from the second wood member and the second wood member extends beyond the first wood member, with the juncture of the members registering with opening 47 in the table. The wood members are laid on the table in the pattern shown by placement between the stops defining the pattern with the table pulled out in its loading position so that there is no obstruction to the placement of the wood members. Then, the table 41 is pushed in to bring the juncture into the position for the driving of a top connector plate and a bottom connector plate into the chord members at said juncture, the bottom plate being driven up through hole 47 which is positioned therefor in accordance with the positioning of the table resulting from its engagement with the stop 83.

For safety, the apparatus may be provided with side guards 93 and a front guard 95 for the throat 59. These guards are preferably fixed in place because the table can be moved out so there is no need for access to the throat 59. However, conventional movable guards could also be used. A pair of finger actuated switches 97 are provided for triggering the drivers 25, 29 to shear connector plates from the coils and drive them into the wood members when the table 41 is in position. The switches 97 must be depressed substantially simultaneously to trigger the drivers to inhibit the operator from triggering the driver unless his hands are well clear of the throat 59. In the preferred embodiment, the actuator switches 97 are DUO-TOUCH Model No. OTBA5QD photoelectric touch switches available from Banner Engineering Corporation of Minneapolis, Minn.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for connection of wood members in which wood members are fastened together by at least one connector plate segmented from a continuous strip of connector plates, said plates having integral nails extending from one face thereof and connected end-to-end lengthwise of the strip, said apparatus comprising a frame having a front and a back, said frame have a throat in a generally horizontal plane, open at the front thereof and having a rear, a feeder associated with the frame operable to feed a strip over the throat with the nails of the strip extending down to bring the leading plate of the strip to a position over the throat for being segmented from the strip and driven downward, a driver in the frame above the throat for driving down the plate segmented from the strip, a table carried by the frame for movement of the plane of the throat between a forward position extending forward out of the front of the frame in the plane of the throat for emplacement on the top of the table of said members in a pattern for being fastened together and a rearward position in a throat under said driver for the driving of a connector plate segmented from the strip down into said members, and jigging members carried by the table for movement therewith, the jigging members being movable with respect to the table for engaging side of said wood members to position said wood members in said pattern.

2. Apparatus as set forth in claim 1 wherein the table is mounted for forward and rearward sliding movement in said plane of the throat between its said positions.

3. Apparatus as set forth in claim 2 wherein said jigging members are settable for different patterns of said wood members on the table.

4. Apparatus as set forth in claim 1 wherein the table has a series of slots therein, the jigging members comprising stops releasably fastened in certain slots in selected position extending up from the table for the jigging of said wood members in a selected pattern.

5. Apparatus for connecting wood members in which wood members are fastened together by connector plates segmented from continuous strips of connector plates, and said plates having integral nails extending from one face thereof and connected end-to-end lengthwise of the strips, each strip being supplied in coil format, said apparatus comprising a frame having a front and a back, said frame having a throat in a generally horizontal plane, open at the front thereof and having a rear, an upper feeder associated with the frame operable to feed an upper strip from a coil thereof over the throat with the nails of the upper strip extending down to bring the leading plate of the upper strip to a position over the throat for being segmented from the upper strip and driven downward, a lower feeder associated with the frame operable to feed a lower strip from a coil thereof under the throat with the nails of the lower strip extending up to bring the leading plate of the lower strip to a position under the throat for being segmented from the lower strip and driven upward, an upper driver in the frame above the throat for driving down the plate segmented from the upper strip, a lower driver in the frame under the throat for driving up the plate segmented from the lower strip, a table carried by the frame for movement in the plane of the throat between a forward position extending forward out of the front of the frame in the plane of the throat for emplacement on the top of the table of said members in a pattern for being fastened together and a rearward position in the throat between said drivers for the driving of a connector plate segmented from the upper strip down into said members and the driving of a connector plate segmented from the lower strip up through an opening in the table into said members, and jigging members carried by the table for movement therewith, the jigging members being movable with respect to the table for engaging sides of said wood members to position said wood members in said pattern.

6. Apparatus as set forth in claim 5 wherein the table is mounted for sliding movement in said plane of the throat between its said positions.

7. Apparatus as set forth in claim 6 wherein said jigging members are settable for different patterns of said wood members on the table.

8. Apparatus as set forth in claim 7 wherein the table is mounted for sliding movement by means of a set of rods and a set of slide bearings under the table, one of said sets being mounted on the frame.

9. Apparatus as set forth in claim 8 wherein said bearings are mounted on the frame with their axis extending parallel to one another on opposite sides of the throat in a generally horizontal plane below the plane of the table, said rods being secured to the table in position below the table extending parallel to one another in the plane of the bearings, the rods being slidable in the bearings carrying the table for the sliding movement thereof between said positions of the table.

10. Apparatus as set forth in claim 9 wherein the table has an inner edge which, in the position of the table between the drivers, is located adjacent the rear of the throat and which, in the loading position of the table, is located adjacent the front of the throat, and wherein each of the rods is secured to the table in a position below the table spaced down from the table extending parallel to one another by a pair of rod supports, one adjacent the inner end of the rod and adjacent the inner edge of the table, the other adjacent the outer edge of the table, at least one of the bearings being mounted in position to act as a stop engageable by an inner end rod support on pulling out the table to determine its said loading position, and at least one of the bearings being mounted in position to act as a stop limiting inward sliding of the table to determine its said position for the driving of connector plates.

11. Apparatus as set forth in claim 10 wherein the table has at least one handle for being grasped to pull it out to the loading position.

12. Apparatus as set forth in claim 5 wherein said jigging members are settable for different patterns of said wood members on the table.

13. Apparatus as set forth in claim 12 wherein the table has a series of slots therein, the jigging members comprising stops releasable fastened in certain slots in selected positions extending up from the table for the jigging of said wood members in a selected pattern.

14. Apparatus as set forth in claim 13 wherein the slots in the table extend parallel to one another in front-to-rear direction with regard to the throat.

15. Apparatus as set forth in claim 14 wherein each stop has a bolt extending down through one of the slots, and a nut on the bolt engageable with the bottom of the table for fastening the stop in place.

* * * * *

UNITED STATES PATENT AND TRADEMARK OFFICE

CERTIFICATE OF CORRECTION

PATENT NO. : 6,330,963 B1
DATED : December 18, 2001
INVENTOR(S) : Marc Olden et al.

It is certified that error appears in the above-identified patent and that said Letters Patent is hereby corrected as shown below:

Column 5,
Line 40, “have a throat” should read -- having a throat --.
Line 48, “movement of the plane” should read -- movement in the plane --.

Signed and Sealed this

Tenth Day of September, 2002

*Attest:*

*Attesting Officer*

JAMES E. ROGAN
*Director of the United States Patent and Trademark Office*